US005765813A

United States Patent [19]

Lam et al.

[11] Patent Number: 5,765,813

[45] Date of Patent: Jun. 16, 1998

[54] WELLHEAD PRODUCTION BLOWOUT PREVENTER RAM

[75] Inventors: Tony M. Lam; Keith D. Farquharson, both of Edmonton, Canada

[73] Assignee: Stream-Flo Industries, Ltd., Edmonton, Canada

[21] Appl. No.: 655,722

[22] Filed: May 30, 1996

[51] Int. Cl.[6] ..... E21B 33/06

[52] U.S. Cl. ..... 251/1.3; 251/1.1

[58] Field of Search ..... 251/1.1, 1.3

[56] References Cited

U.S. PATENT DOCUMENTS

Re. 18,655 11/1932 Jensen ..... 251/1.3

*Primary Examiner*—John Fox

*Attorney, Agent, or Firm*—Sheridan Ross P.C.

[57] ABSTRACT

The rubber layer on the ram is reinforced at the sealing areas by forming ribs on the ram core. The ribs function to resist extrusion of the rubber layer when the blowout preventer is subjected to high pressure from the well.

2 Claims, 5 Drawing Sheets

FIG. 6.
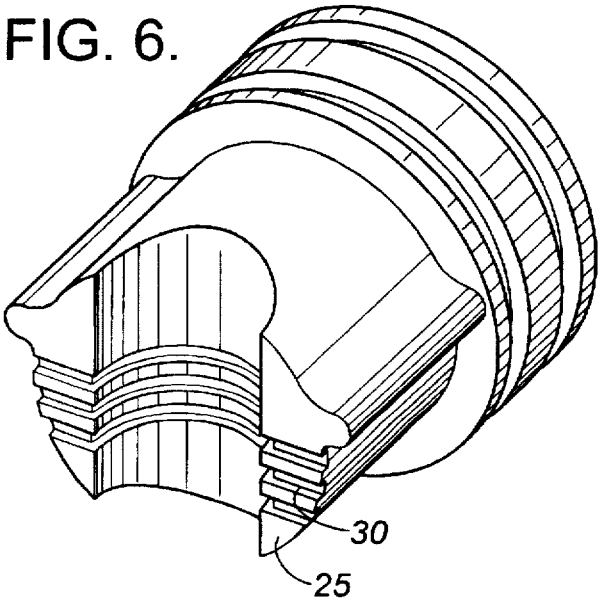
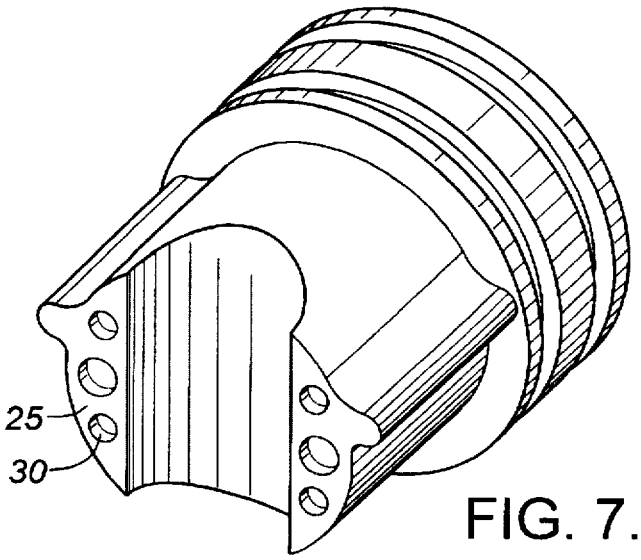
FIG. 7.
FIG. 8.
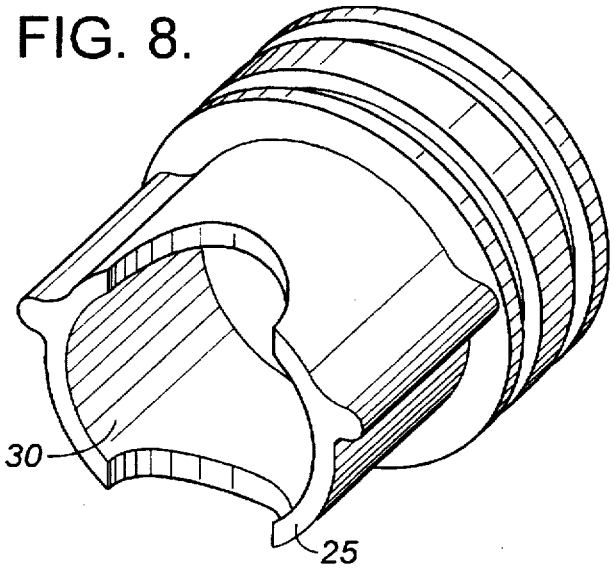

WELLHEAD PRODUCTION BLOWOUT PREVENTER RAM

TECHNICAL FIELD

This invention relates to the rams used in a wellhead production blowout preventer.

BACKGROUND ART

The invention has to do with improving the rams in a known oilfield wellhead assembly component known as a production blowout preventer (hereafter "BOP").

This type of BOP is commonly used in connection with pumping wells. With such wells, a sucker rod string is reciprocated or rotated to drive a downhole pump, which lifts the produced fluid to surface through a tubing string.

The BOP is equipped with rams which can be advanced horizontally to seal around the vertical polish rod of the rod string, to prevent the upward escape of fluid. Alternatively, if the rod string is out of the well, the inner ends of the rams can be pressed together to effect closure of the wellhead assembly fluid passageway.

More particularly, the BOP comprises a cross-shaped housing forming a vertical bore and a pair of coaxial, horizontal ram bores intersecting the vertical bore from each side. The BOP is commonly positioned in the wellhead assembly between the tubing head and flow tee. The BOP vertical bore therefore forms part of the wellhead assembly fluid passageway.

A pair of rams is positioned in the ram bores. Means, such as screw jacks, are provided at the outer ends of the bores, for advancing or retracting the rams into or out of the vertical bore.

Each ram comprises a generally cylindrical body. The body comprises a steel core having an outer full diameter portion and a reduced diameter inner portion. The core inner portion is covered with and bonded to a layer of elastomer, typically nitrile rubber.

The cylindrical ram bores extend into the vertical bore and the bore surfaces combine at their intersection to form sealing areas. When the rams move into the vertical bore, the rubber surfaces of their inner portions seal against the sealing surfaces.

The rubber-coated inner face of each ram is formed to provide a semi-circular, vertically directed groove. Thus, when the polish rod of the rod string is present in the vertical bore, the ram ends encircle and press against it, to effect a seal. When the polish rod is not in the vertical bore, the ram ends compress together to form a solid block. In both cases, the circumferential seals of the ram side surfaces with the sealing areas and the end face seals combine to close the vertical bore and contain pressurized fluids seeking to pass therethrough.

One problem associated with production BOP's is that the pressure acting from below on the closed rams may extrude the side rubber upwardly so that the circumferential seal with the sealing areas is lost.

Another problem is that the end rubber bonded to the vertical end faces of the ram cores may tear loose from the core when high pressure is exerted from below.

It is therefore an objective of the invention to provide an improved ram, which when used in combination with the BOP housing, is better able to withstand high pressure from below without losing the side seal. It is a preferred objective to provide such a ram-wherein the rubber is more securely bonded to the core end face, so that it may better resist being torn loose.

SUMMARY OF THE INVENTION

In accordance with the main feature of the invention, the side surface of each ram core inner portion is formed to provide ribs extending outwardly therefrom and extending longitudinally thereof. The ribs are located so as to underlie those portions of the elastomer layer which seal against the sealing areas. The elastomer layer is thinned where it passes over the ribs, to preserve the cylindrical shape of the ram's inner portion.

The ribs function to reinforce the elastomer layer against upward extrusion. Comparative pressure tests have shown that a ribbed ram was able to contain several times the pressure that a non-ribbed ram could contain, before the seal was lost.

The expression "ribs" is to be widely construed. The ribs may be continuous or discontinuous. What is needed is a rigid, elongate, horizontal reinforcement of the elastomer layer along each side of the ram, opposite the sealing areas.

In accordance with a preferred feature, the vertical end face of the core inner portion is indented, for example with a plurality of spaced apart transverse grooves or dimples or a single cavity, so that the base of the elastomer layer projects into these indentations. As a result, increased face surface area is provided to bond with the elastomer. In addition, the elastomer external of the indentations must shear from the elastomer in the indentations, before failure occurs and the elastomer separates from the steel. In this way, the resistance to failure of the elastomer/steel bond at the ram end faces is improved.

DESCRIPTION OF THE DRAWING

FIG. 6 is a perspective view of the core having grooves formed in its inner end face;

FIG. 7 is a perspective view of the core having dimples formed in its inner end face; and FIG. 8 is a perspective view of the core having a pocket formed in its end face.

DESCRIPTION OF THE PREFERRED EMBODIMENT

Figure 1:
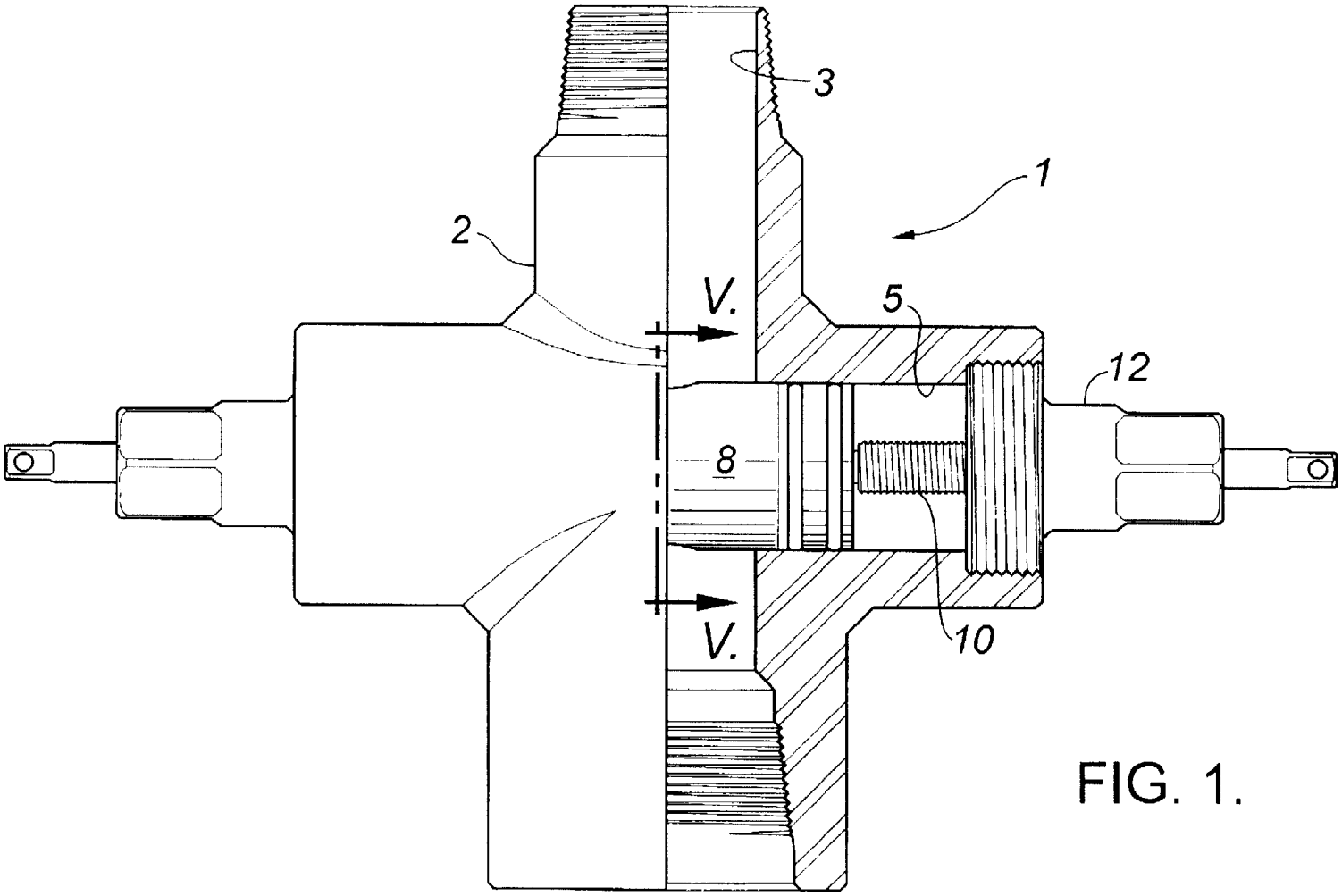
FIG. 1 is a partly sectional side view of a production blowout preventer in accordance with the invention.
Figure 2:
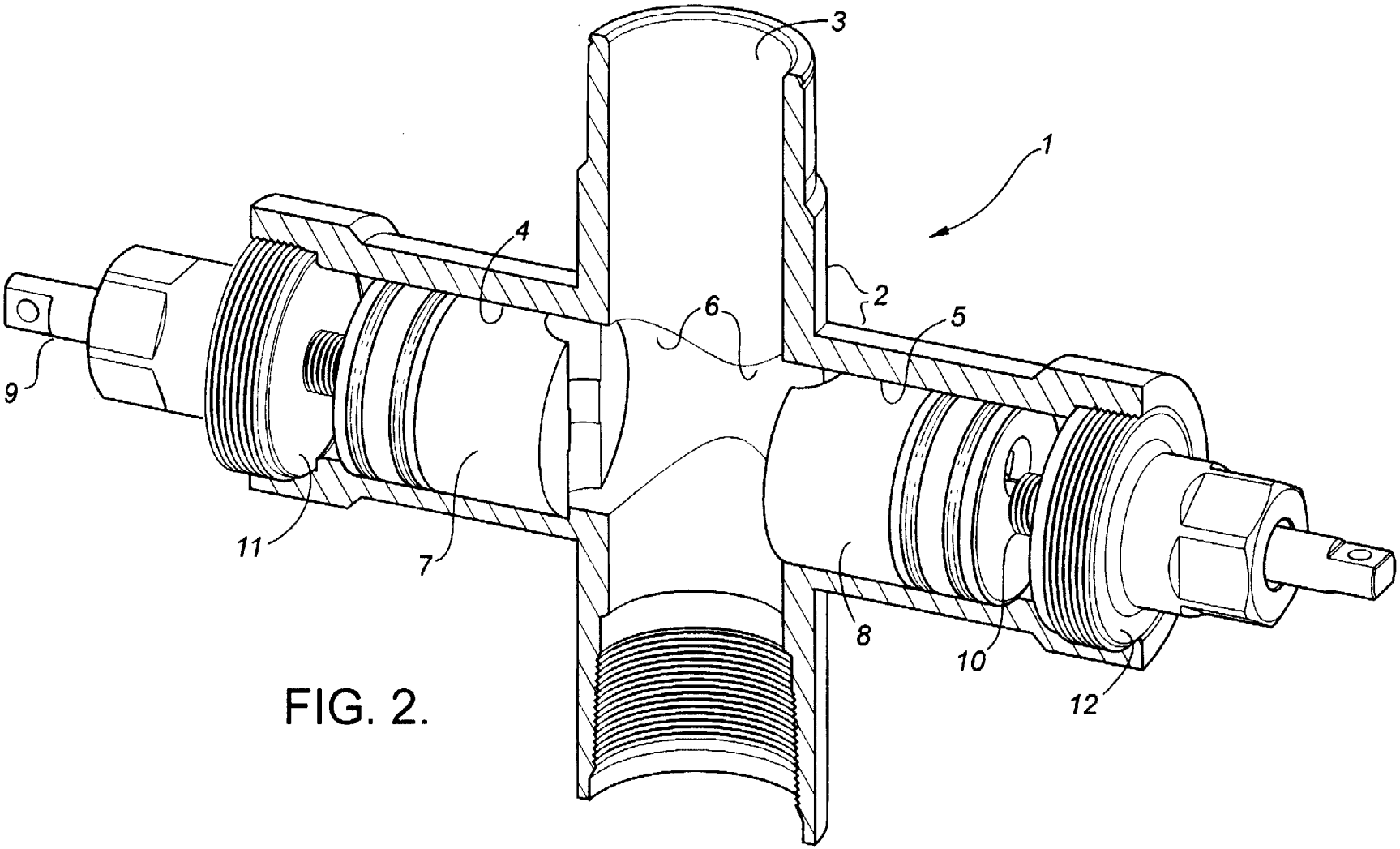
FIG. 2 is a partly sectional perspective view showing the production blowout preventer of FIG. 1.

Having reference to FIGS. 1 and 2, the production blowout preventer 1 comprises a cross-shaped housing 2 forming a vertical bore 3 and a pair of coaxial horizontal ram bores 4,5. The ram bores 4,5 intersect with the vertical bore 3 and form sealing areas *6a*, *6b*.

A pair of generally cylindrical rams 7,8 are located within the ram bore 4,5. Screw jacks 9,10 extend through plugs 11,12 threaded into the outer ends of the ram bores 4,5. The screw jacks 9,10 can be turned to advance or retract the rams 7,8 into or out of the vertical bore 3.

Figure 3:
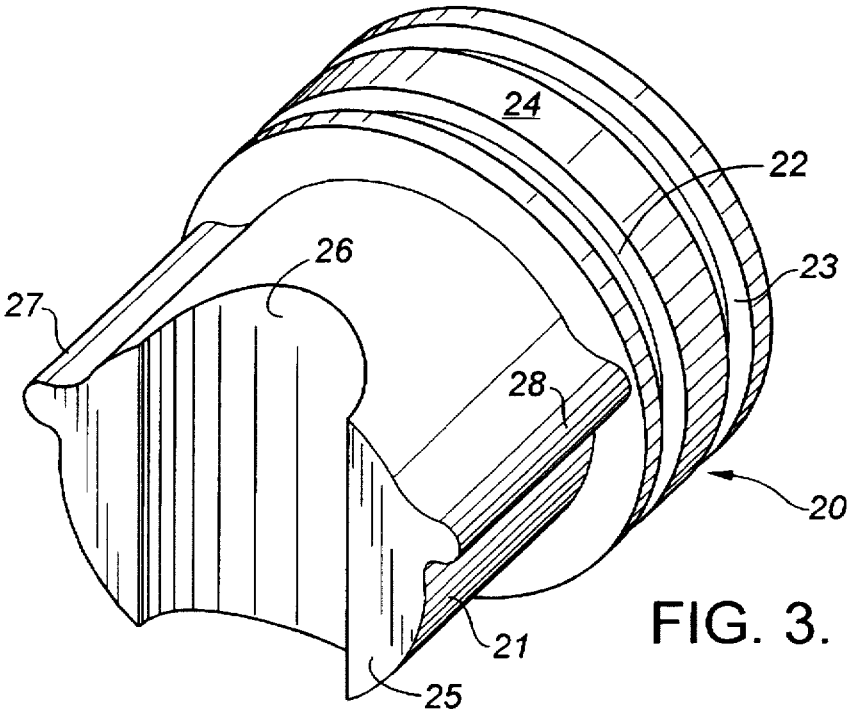
FIG. 3 is a perspective view of the steel core forming part of the ram.

A steel core 20 is shown in FIG. 3. The core 20 comprises inner and outer portions 21, 22.

The outer portion 22 has a full diameter, so as to maintain a close sliding fit with the surface of the ram bore containing it. The outer portion 22 carries O-ring seals 23 seated in circumferential grooves formed by its outer surface 24.

The core inner portion 21 has a comparatively reduced diameter. Its inner end face 25 forms a vertical grove 26.

A pair of reinforcing ribs 27, 28 protrude outwardly from and extend longitudinally of the core inner portion 21. The ribs 27,28 are positioned opposite the sealing areas 6*a*, 6*b*.

Preferably, indentations 30 are formed in the core's inner end face 25, as shown in FIGS. 6–8.

Figure 4:
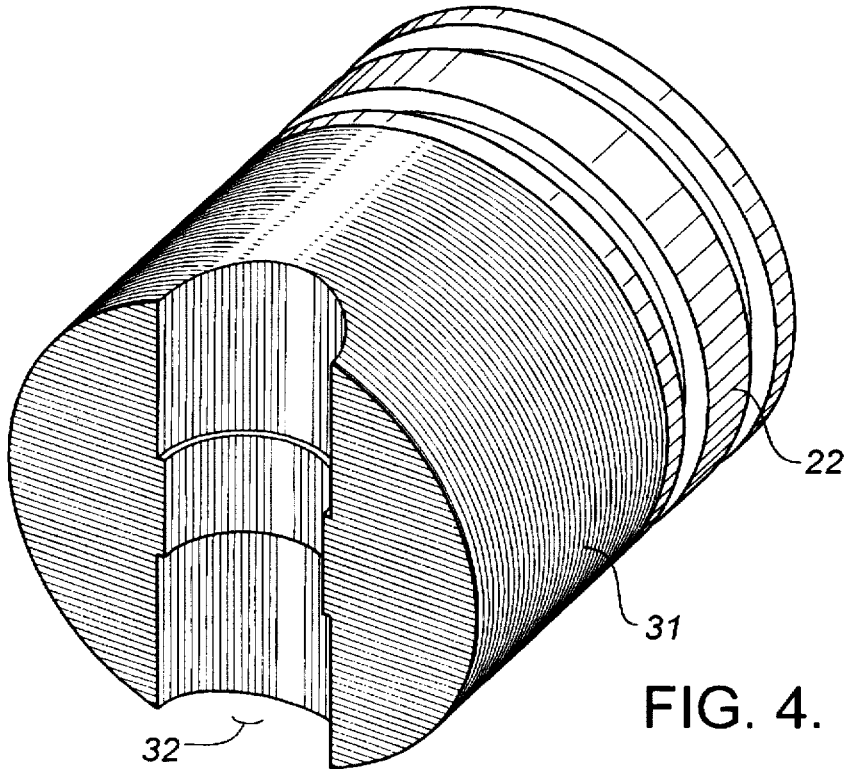
FIG. 4 is a perspective view of the ram comprising the core having its inner portion covered with molded rubber.
Figure 5:
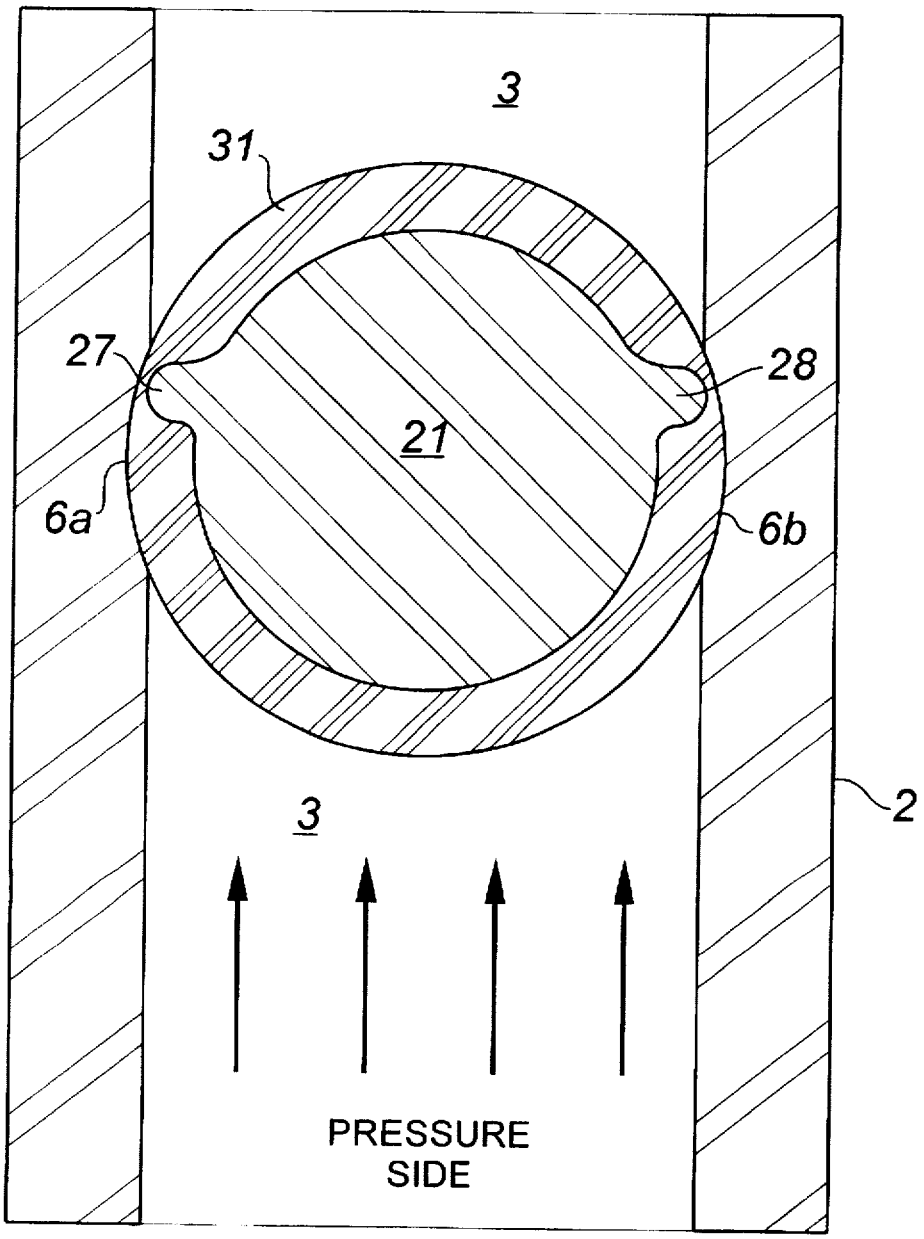
FIG. 5 is a sectional end view showing a ram extended into the vertical bore.

A layer 31 of rubber is molded onto the core inner portion 21, as shown in FIGS. 4, 5. The layer 31 is thinned over the ribs 27, 28 and extends into the indentations 30. A vertical groove 32 is formed to receive the polish rod (not shown).

Testing was conducted using an assembled BOP and polish rod. The rams were engaged with the rod and hydrostatic pressure was applied below the rams. Several rams, both with and without ribs, were tested to determine their pressure holding capability. The rams without ribs failed at about 500–600 psi. The same rams, but having ribs, failed at about 3700 psi.

The embodiments of the invention in which an exclusive property or privilege is claimed are defined as follows:

1. In a production blowout preventer comprising a housing forming a vertical bore extending longitudinally therethrough and a pair of coaxial horizontal ram bores extending transversely thereof and intersecting the vertical bore to form opposed sealing areas, said ram bores each containing a generally cylindrical ram, the rams being slidable along the ram bores so as to project into the vertical bore where they may seal against a rod string extending therethrough or may contact to close the vertical bore if the rod string is absent, each ram comprising a rigid core having a cylindrical outer end portion whose diameter is close to that of the horizontal bore containing it, a cylindrical inner end portion having a comparatively reduced diameter, and a vertical inner end face, said core inner end portion and inner end face being covered by a layer of elastomer bonded thereto, the improvement comprising:

each ram core inner portion having ribs projecting outwardly therefrom and extending longitudinally therealong so as to underlie the elastomer layer at the sealing areas, said elastomer layer being thinned over the ribs to maintain the diameter of the inner portion, said ribs being operative to reinforce the elastomer layer opposite the sealing areas against upward extrusion by pressure in the segment of the vertical bore located beneath the ram bores.

2. The improvement as set forth in claim 1 wherein:

the core inner end face forms a plurality of spaced apart indentations, so that the elastomer extends into the indentations.

* * * * *